United States Patent [19]

Adams

[11] Patent Number: 4,564,199

[45] Date of Patent: Jan. 14, 1986

[54] TRACER GOLF BALL

[76] Inventor: James S. Adams, 5730 S. Mackinaw, Houston, Tex. 77053

[21] Appl. No.: 575,195

[22] Filed: Jan. 30, 1984

[51] Int. Cl.[4] ..... A63B 43/00; A63B 69/36; A63B 37/02

[52] U.S. Cl. ..... 273/213; 273/219

[58] Field of Search ..... 273/213, 219, 62, 214, 273/215, 216, 220, 230, 231

[56] References Cited

U.S. PATENT DOCUMENTS 1,260,788 3/1918 Miller ..... 273/213

1,583,721 5/1926 Kane ..... 273/213

*Primary Examiner*—George J. Marlo

[57] ABSTRACT

This tracer golf ball enables its user to observe easily the roll and other characteristics that take place when the ball is in flight. Primarily, it includes a center chamber filled with a chemical smoke-producing agent, and the body of the ball also includes a membrane and sleeve combination, which serve as a release valve for chemical smoke, which will trail the ball in its flight, after it has been struck. The core of the ball also includes air chambers which enable the ball to float in water.

1 Claim, 5 Drawing Figures

FIG. 1
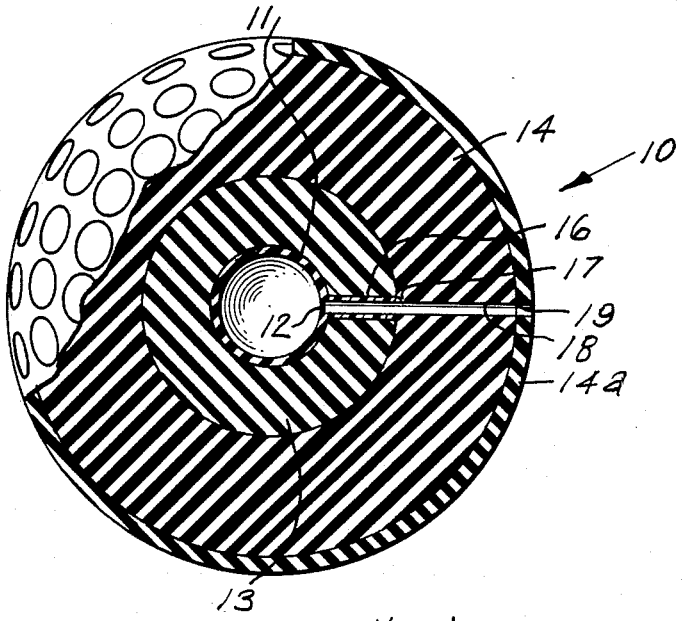
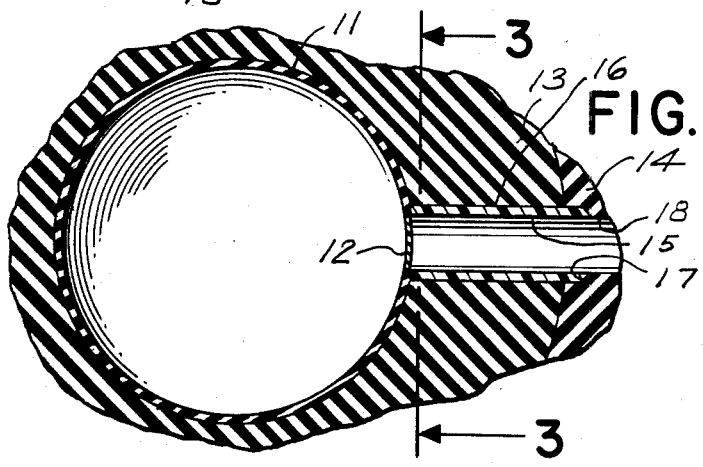
FIG. 2
FIG. 3
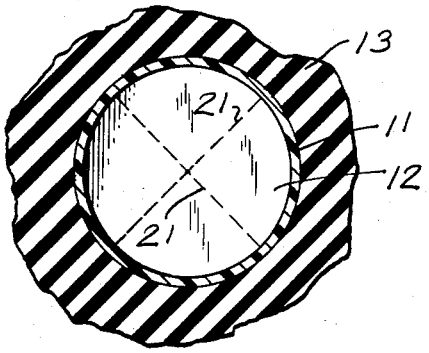
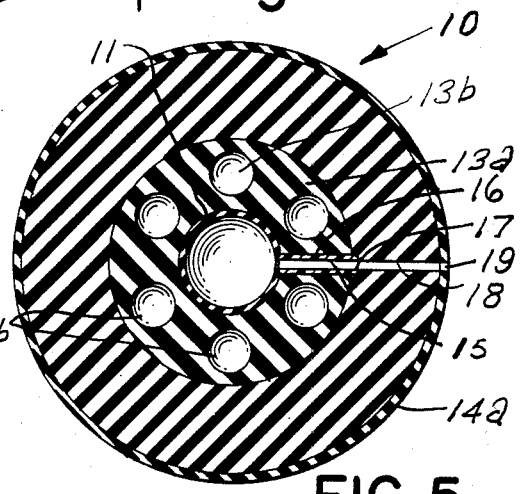
FIG. 5
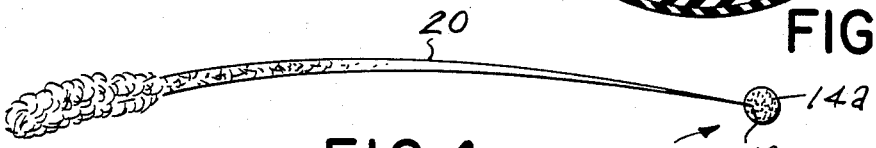
FIG. 4

TRACER GOLF BALL

This invention relates to balls used in sports, and more particularly, to a tracer golf ball.

The principal object of this invention is to provide a tracer golf ball, which will serve as a practice ball, to aid golfers in determining if they hit the ball correctly.

Another object of this invention is to provide a tracer golf ball, which will release a trail of non-toxic smoke when it is struck by a golf club on tee-offs.

Another object of this invention is to provide a tracer golf ball, which will produce a chemical smoke, that will remain in the atmosphere for only a few seconds before dissolving.

A further object of this invention is to provide a tracer golf ball, which will be fabricated to include a chemical smoke-filled chamber, that will be ruptured by a small rubber or plastic tube, when the ball is struck by a club, but will not rupture when the ball is dropped.

Other objects are to provide a tracer golf ball, which is simple in design, inexpensive to manufacture, rugged in construction, easy to use, and efficient in operation.

These, and other objects, will be readily evident, upon a study of the following specification, and the accompanying drawing, wherein:

FIG. 1 is an enlarged plan view of the present invention, shown partly broken away, with the smoke agent removed therefrom;

FIG. 2 is a further enlarged fragmentary view of FIG. 1;

FIG. 3 is a cross-sectional view, taken along the line 3—3 of FIG. 2;

FIG. 4 is a side elevational view of the invention, shown in flight, and

FIG. 5 is an enlarged plan view of a modified form of the invention, shown in cross-section.

Accordingly, a ball 10 is shown to include a hollow spherical rubber chamber 11, which is designed to retain a suitable chemical agent, such as titanium tetrachloride (not shown). This agent produces a smoke when chamber 11 is ruptured, for enabling the golfer to observe the motion of ball 10 during its flight path. An opening in the wall of chamber 11 includes a thin rubber membrane 12, which is fixedly secured therein by suitable means, and the membrane 12 is designed to be the point where chamber 11 will rupture, when ball 10 is struck by a golf club. Chamber 11 is encased within a spherical rubber core 13, which is received in the center of a thicker and spherical outer wall 14, also of a suitable rubber material, and the outer periphery of outer wall 14 includes a typical dimple surfaced rubber skin 14*a*, which is common in the art. An opening 15, through the core 13, includes a plastic tube or sleeve 16, which projects partially into shoulder portion 17 of an aligned opening 18 through outer wall 14. An opening 19, through skin 14*a*, also aligns with openings 15, 19, and the opening covered by membrane 12, and serves as a discharge throat for the chemical smoke, after ball 11 has been struck, and the tube or sleeve 16 and the membrane 12 combination cooperate as a percussion valve for releasing smoke 20 from ball 10. The membrane 12 also includes equally and radially spaced perforations 21, for greater ease in the rupturing thereof, when ball 10 is struck.

In use, ball 10 is placed on a typical golf tee, and is struck by the golfer's club, in the manner known in the art. When the above occurs, the compression of the ball 10, at any point therein, causes the plastic tube or sleeve 16 to rupture or sever membrane 12, thus causing the immediate release of the chemical smoke-producing agent from chamber 11, whereupon it is exhausted from opening 19 into the atmosphere, and the result is, that the course of the ball 10 in flight is easily observed, particularly, regarding its degree of roll, as well as its arcuate flight path or trajectory.

It shall also be noted, that the design of ball 10 is such, that it is indispensable as a golfing aid to people who desire to improve their drive of a golf ball, and the golfer is able to see more precisely what the ball is doing in flight, thus enabling the user to adjust his club grip and stroke, accordingly.

Referring now to FIG. 5 of the drawing, a modified ball 10 includes a modified core 13*a*, the other components remaining the same as heretofore described. Core 13*a* includes a plurality of equally and radially spaced air chambers 13*b*, which serve to provide flotation for ball 10, if it should land in a water trap or the like, thus enabling it to be retrieved more easily.

In use, when ball 10, with its modified core 13*b*, falls into water, the air chambers will immediately cause it to float to the surface of the water.

While various changes may be made in the detail construction, it is understood that such changes will be within the spirit and scope of the present invention, as is defined by the appended claims.

What I now claim is:

1. A tracer golf ball, comprising, in combination, a spherical outer wall having a dimpled outer skin, a rubber core inside said outer wall, a spherical opening in a center of said core, a thin membrane lining said opening, a smoke producing chemical agent surrounded by said membrane, a radially extending opening through said wall extending from said membrane to an outer surface of said skin, perforations in said membrane for easy rupture of said membrane when said ball is being struck, for outward escape of said chemical agent, and a plurality of flotation air chambers contained in said core.

* * * * *